US006257906B1

(12) United States Patent
Price et al.

(10) Patent No.: US 6,257,906 B1
(45) Date of Patent: Jul. 10, 2001

(54) FUNCTIONALLY ILLUMINATED ELECTRONIC CONNECTOR WITH IMPROVED LIGHT DISPERSION

(75) Inventors: Tim Urry Price, Salt Lake City; Scott W. Rupp, Grantsville; Charles Eric Posey, Salt Lake City; Nathan A. Mueller, Sandy; Thomas A. Johnson, Draper, all of UT (US)

(73) Assignee: 3Com Corporation, Santa Clara, CA (US)

( * ) Notice: Subject to any disclaimer, the term of this patent is extended or adjusted under 35 U.S.C. 154(b) by 54 days.

(21) Appl. No.: 09/246,534

(22) Filed: Feb. 8, 1999

(51) Int. Cl.[7] ..... H01R 13/60
(52) U.S. Cl. ..... 439/131; 439/490; 439/910
(58) Field of Search ..... 439/131, 488, 439/489, 490, 910, 955

(56) References Cited

U.S. PATENT DOCUMENTS 4,978,317 * 12/1990 Pocrass ..... 439/490
5,463,261 * 10/1995 Skarda et al. ..... 439/955
5,667,395 * 9/1997 Okada et al. ..... 439/131
5,741,152 * 4/1998 Boutros ..... 439/910
5,790,041 * 8/1998 Lee ..... 439/910

* cited by examiner

*Primary Examiner*—T. C. Patel
(74) *Attorney, Agent, or Firm*—Workman, Nydegger & Seeley

(57) ABSTRACT

The present invention relates to an illuminated connector that may be illuminated from a light source that is not immediately adjacent to the connector. The connector is illuminated by projecting a focused beam of light onto a translucent portion of the connector. The focused beam of light may then be redirected so as to illuminate selected sections of the connector in order to indicate diagnostic information or identify the source or model of the electronic device in which the connector is placed.

20 Claims, 4 Drawing Sheets

FUNCTIONALLY ILLUMINATED ELECTRONIC CONNECTOR WITH IMPROVED LIGHT DISPERSION

RELATED APPLICATIONS

This application is a continuation-in-part of U.S. Patent Application Ser. No. 09/187,175, filed on Nov. 5, 1998, which is incorporated herein by reference.

BACKGROUND OF THE INVENTION

The Field of the Invention

The present invention relates to electronic connectors used in the computer and communications industry. More particularly, the present invention relates to a functionally illuminated electrical connector capable of visibly communicating the connector location, the state or condition of the connection, diagnostic information about the device, manufacturer source identification or other information.

The Relevant Technology

Electronics connectors in the computer and communications industry are available for a wide array of applications from communications and data transfer applications to power connections. Due to the pace of technology in this area and the trend toward smaller, more efficient and more capable hardware, connectors evolve on an almost daily basis. A plethora of standards have evolved for specific connector and hardware applications, however proprietary connectors proliferate throughout the industry.

One area in which an industry standard prevails is that of data and voice communications connectors where the standard RJ-11 and RJ-45 plugs and jacks are common throughout the United States and many foreign countries. The RJ-11 is a standard phone line connector also used for most modem connections, while the similar and slightly larger RJ-45 plug has more conductors and is used as a standard computer network connection. These connectors have been the industry standard for many years and are likely to remain so in the future for telephones, desktop computer modems and network adapters, and other substantially stationary communications equipment. However, hardware technology and the "miniaturization" of components has progresssed to the point that the standard RJ connectors are bigger than the thickness of the hardware to which they connect.

An example of these smaller hardware configurations is the PC Card Standard promulgated by the Personal Computer Memory Card International Association (PCMCIA). The PCMCIA PC Card standard identifies three primary card types: Type I, II and III. These types correspond to physical dimension restrictions of 85.6 mm (length)×54.0 mm (width) and thicknesses of 3.3 mm, 5.0 mm and 10.5 mm respectively.

As a consequence of hardware miniaturization in the face of a nearly worldwide RJ connector standard, hardware manufacturers have developed myriad proprietary hardware connection standards and an assortment of connectors and adapters that allow the RJ plugs to be connected to small profile hardware.

One such adapter is shown in FIG. 1 where an adapter cable connector or "podule" 6 for a PCMCIA ethernet adapter is shown. The narrow profile connector 4 on the end of the adapter cable that connects to the PC Card is shown. The other end of the adapter cable comprises a larger profile receptacle which receives a standard RJ plug. This type of adapter is also known as a "dongle" after the way it dangles out of the computer card. Dongle connectors may be fitted with LED's 8, however, this configuration is inefficient and troublesome as the LED leads must be hand soldered to an internal printed circuit board (PCB) or to terminals on the connector. The leads of the LED's must also be sleeved to prevent shorting with the shield of the ethernet adapter cable.

Another, more convenient, connector which allows connection of the standard RJ type plug with narrow profile hardware is the XJACK® produced by 3Com Corporation, Salt Lake City, Utah. The XJACK® is a narrow profile connector designed to be contained within hardware such as PC Card standard compliant devices. The XJACK® comprises a thin body with an aperture therein for receiving a standard RJ connector plug or some other connector. One embodiment of the XJACK® is shown generally in FIG. 2. It may be retractable within the device or detachable therefrom.

The standard RJ connector is quite small. The various proprietary connectors are even smaller and tinier connectors arrive in the industry as technology progresses. Connectors of this size are often difficult to locate and use as their location and orientation vary from product to product. These connector locations are often placed at the rear or side of communications and computer hardware where they can be difficult to find.

Furthermore, it is generally desirable to know the state or condition of a telephone/modem or network communications connection to determine whether the physical connection has been accomplished and whether the connection has been correctly configured. This state or condition may be indicated through the use of LED's on the dongle podule or other portion of the adapter cable, however, this location is problematic as explained above. Due to the often remote location of the connectors and their ever decreasing size, brightly illuminated connectors are needed to indicate connector location and connection conditions.

Connector illumination may also serve to indicate the source of origin of the hardware to which the connector is connected. When PC Card standard cards are inserted into an electronic device, they are generally invisible to the user as the device completely surrounds the card. A user who swaps several cards into and out of his computer needs to know which cards are installed so that he can properly configure the computer to use the cards. At this stage it is desirable to have visual indicia available to indicate which card is inserted simply by looking at the connector protruding from the card slot. This function has been performed by printed indicia on dongle cables and their podules and other connectors, however, these adapters and cables may be lost or switched making identification unreliable. What is needed is an illuminated connector which can identify the card to which it is directly attached.

In addition to physical and electrical configuration standards, computer and communications connectors must conform to safety standards as well. For example, the voltage levels required for ringing a telephone, which are also present in modem connections, require the same insulation, arc resistance and safety requirements as a 110 volt power receptacle in a home or office. A connector or jack must also meet certain flammability standards such as those established by Underwriter's Laboratories, UL®. UL® has established preferable flammability ratings ranging from V0 to V5 with V5 being the most preferable. A horizontal burn rating (HB) is also preferable. The 94-V0 flammability rating is also desirable for this application.

Narrow profile connectors also require a high degree of structural integrity as their cables are often flexed and pulled while in use. Fiber reinforcement and other additives have been used to strengthen the materials used for these connectors. These additives, however, typically make the material opaque and dark and detract from the translucence of the material.

What is needed is a computer or communications device connector which can indicate its location, its manufacturer, and other parameters such as network availability, dial tone, connection state or condition, etc. in a reliable and easily recognizable manner.

SUMMARY AND OBJECTS OF THE INVENTION

The present invention relates to a functionally illuminated connector for making connections between two electrical devices. The present invention may be applied to such receptacles as a telephone jack, a computer ethernet jack, a modem jack, or a peripheral jack. It may also be applied to such receptacles as a television antenna jack, a videocassette recorder (VCR) cable jack, a video game unit, and the like. However, the present invention is particularly adapted to providing an illuminated jack for a computer device. In particular, the present invention is particularly useful for providing an illuminated jack for a PCMCIA ethernet or modem card.

A first preferred embodiment of the present invention relates to a jack for receiving an RJ-11 or RJ-45 plug, or other connectors for electronic transfer of voice, data, power or other signals.

In the present invention, the inventive illuminated jack is made of a translucent material that meets or surpasses UL® standards. Such safety standards include electrical resistivity, resistance to flammability, and structural strength.

The present invention provides for a functionally illuminated connector with high luminescence and light dispersion. The connector of the present invention may be illuminated with a light source such as an incandescent light, an LED, so long as this light source is concentrated or focused into the connector. This focusing and concentrating may be achieved by the use of a parabolic reflector or preferably a fresnel lens which will focus a concentrated beam of light onto the connector. A laser may also be used to direct a focused or concentrated beam of light onto the connector. The connector may also be configured with reflective or refractive surfaces in order to achieve local illumination of sections of the connector surface for both product identification and for a diagnostic display to the user. The connector itself as a whole may also act as a diagnostic display to the user. The manufacturer's name or the type or model of device may also be indicated by illumination of the connector or parts thereof which are formed or printed with such indicia.

A first embodiment of the present invention comprises a translucent connector that is fixed at or near the edge of a computer or other electronic device and that is substantially illuminated by a concentrated beam of light coming from a light source within the device. One or more beams of light are directed to the translucent connector body and these beams of light from one or more concentrated sources may be redirected to preferred portions of the connector by the use of one or more refractive or reflective surfaces. In a preferred embodiment, surfaces of the connector can be coated with a reflective material that causes substantially all light to exit the connector through the sections designated as functional indicators.

In another embodiment of the present invention, the inventive connector takes the form of a jack that is extendable beyond the edge of an electronic device such as an XJACK® which is made of a translucent material and is illuminated by a light source positioned within the electronic device, preferably upon a PCB. Light may be preferentially redirected and/or blocked within the XJACK® structure by the placement of selected reflective or refractive surfaces that may be formed into, painted onto or otherwise adhered to the body of the translucent jack. The XJACK® may be connected internally by a flexible circuit, a PCB track-and-runner configuration or other connection.

In another embodiment of the present invention, an alligator jack is provided that is translucent and that may likewise be illuminated by a concentrated light source. Additionally, reflective surfaces may be placed within the alligator jack to redirect light according to a preferred configuration. As with the fixed jack and the XJACK, the alligator jack may also be preferentially painted or coated with a reflective material so as to cause light to exit through selected local areas of the translucent body of the jack.

Another object of the present invention is to provide a diagnostic display through designated sections of the connector or illumination of the connector with designated colors so that the user may determine a diagnostic condition of the connector or circuit established thereby by the illumination pattern displayed through the connector. Diagnostic condition may be indicated by mere illumination alone, lack thereof, color, various intermittent blinking patterns, combinations of more than one color, combinations of blinking and color, combinations of blinking and color combinations, and by other modes.

Another object of the present invention is product identification. The connector may be molded, formed, printed or otherwise manufactured such that the manufacturer, model or type of device connected to the connector is visibly displayed by illumination. Alternatively, a trademark color or color identification standard may be indicated through connector illumination of a select color or colors thereby indicating the type of device or manufacturer thereof. Product logos, icons, and trademarks may be displayed through connector molding or coating methods.

It is therefore an object of the present invention to provide an improved method of connecting electronic devices to outside resources such as peripherals, modem cards, modems, networks, antennas, VCR's, video game units, televisions, cable TV systems and components, monitors, telephones and many other devices.

It is also an object of the present invention to eliminate the need for a separate adapter cable that makes a connection between a standard RJ-11 plug, RJ-45 plug or similar connector and a narrow profile electronic device.

Another object of the present invention is to provide an improved electrical connector that maintains safety standards of resistance to electrical arcing and flammability.

It is also an object of the present invention to provide a connector for an electronic device that provides an improved diagnostic output. Additionally, it is an object of the present invention to provide a connector to an electronic device that is visible in low light conditions.

It is another object of the present invention to combine simplified connectivity combined with diagnostic output in a connector. It is also an object of the present invention to provide simplified connectivity combined with diagnostic output and commercial product identification. It is also object of the present invention to provide simplified connectivity combined with improved connector visibility, diagnostic output, and commercial product identification.

A further object of the present invention is an improved method of light transfer from a light source to an exposed translucent electrical connector.

These and other objects and features of the present invention will become more fully apparent from the following, description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The Personal Computer Memory Card International Association (PCMCIA) promulgates the PC Card Standard for narrow profile or thin architecture expansion cards for electronic devices. The PC Card standard designates the physical dimensions of the cards as well as the electrical configuration of the cards including the 68-pin interface between the card and the host device. The physical dimensions of cards conforming to this standard are 85.6 mm in length by 54.0 mm in width. Several thickness variations fall within the standard and are designated by type number. Type I, I, and III PC Cards have thicknesses of 3.3 mm, 5.0 mm and 10.5 mm respectively. Any references to the PC Card Standard or PCMCIA card standard refer to electronic cards substantially conforming to this standard as described herein.

The term miniature modular jack, physical/electrical media connector, fixed jack, XJACK, alligator jack, and the like, connotes a media connector that may have qualities such as those connectors having physical attributes described in F.C.C. Part 68, Subpart F. Specific terms such as RJ-type, RJ-11, RJ-45, 6-pin miniature modular plug, 8-pin miniature modular plug, and similar terminology are all references to specific exemplary physical/electrical media connectors falling within the broader parameters of the term physical/electrical media connectors and are cited by way of example and should not be used to limit the scope of the present invention to specific connectors.

Figure 1:
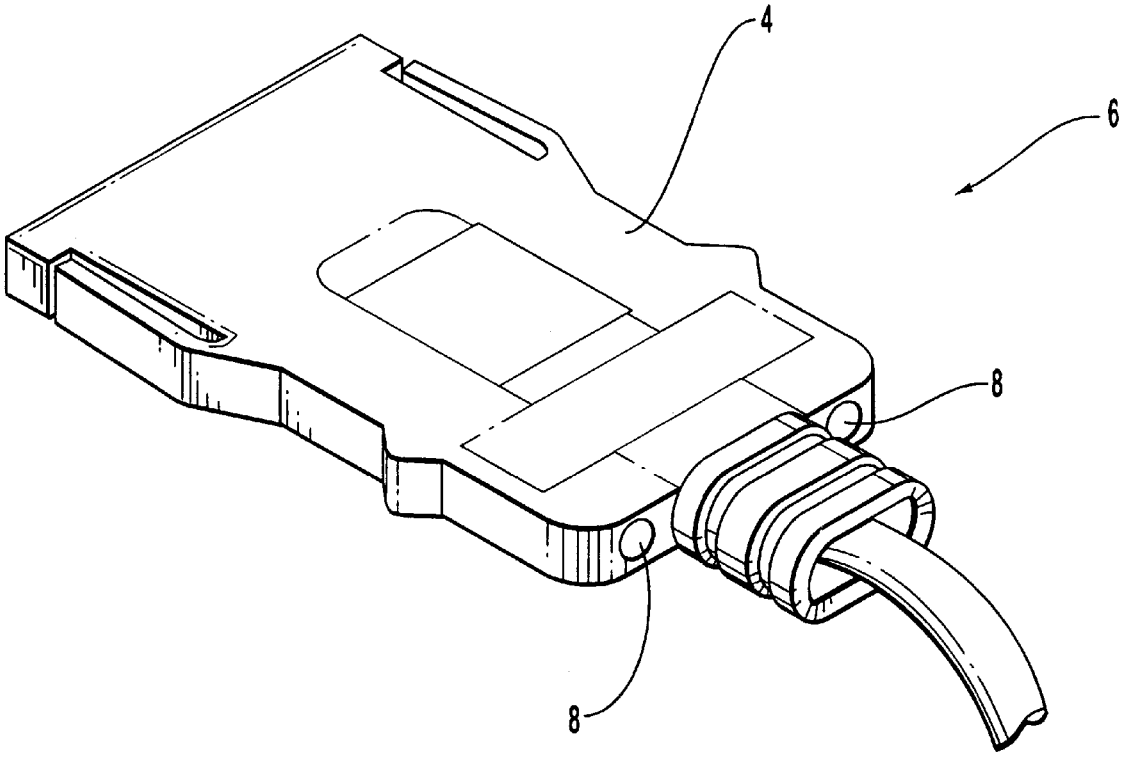
FIG. 1 (PRIOR ART)
FIG. 1 is perspective view of a prior art adapter cable.

A functionally illuminated connector is a connector which, by way of simple illumination, specific illumination color, specific color combinations, intermittent illumination flashing patterns, color combination combined with flashing patterns or other illumination schemes, indicates an attribute of a device or system to which the connector is connected. One example of functional illumination, not to be construed as limiting the scope of the present invention, is the prior art cable connector of FIG. 1 which contains two LED's, typically of different colors. This type of connector is commonly used with a network adapter card where one LED is configured to illuminate thereby indicating that a signal is being received from the network while the second LED is configured to illuminate thereby indicating that network traffic or activity is present on the line. Another example of functional illumination, given by way of example and not limitation, is an illumination scheme used on some network adapters with optional topologies, such as a network adapter capable of providing access using 10Base-T and, alternatively, 100Base-T topologies. These adapters may use a three LED scheme with one LED indicating network signal, another LED indicating a 10 Megabit per second capable connection and the third LED indicating a 100 Megabit per second capable connection. Functional illumination may also indicate whether a card or peripheral device is inserted or connected properly. Functional illumination may also comprise illumination which indicates the location of the connector.

While the above examples all utilize distinct LED's for each indicated attribute, it is to be understood that the scope of the functional illumination of the present invention comprises illumination which indicates one or more attributes using multicolored illumination devices, such as multi-color LED's and illumination devices which may flash intermittently with various patterns, each pattern indicating a distinct attribute or combination of attributes. Again, by way of example and not limitation, an LED or other illumination device may radiate red light to show one attribute or condition and green light to show another while flashing rapidly in one or a combination of colors to indicate a third condition or attribute.

The present invention relates to a connector comprising one or more portions composed of translucent material configured so as to receive a focused beam of light into the connector. This light receiver or means for receiving a focused beam of light comprises a substantially transparent portion of the connector, a lens forms in or attached to the connector or a physical opening in the connector shaped to receive and direct or disperse the incoming light.

The present invention further relates to a means for focusing a beam of light onto the connector which may be mounted on the connector itself or in a separate location apart from the connector. In a preferred embodiment, this means for focusing a beam of light is typically found in close proximity to the connector and mounted on the PCB of a PC Card Standard compliant card. The means for focusing a beam of light comprises reflective and refractive elements including but not limited to a multiplicity of coincidental planar or arcuate reflectors, parabolic reflectors or a fresnel lens used in conjunction with an incandescent light, a fluorescent light or a Light Emitting Diode (LED) or, alternatively, a low power laser may be used as a light source.

As applied to the computer industry, the present invention relates to a computer communication connector comprising one or more portions of substantially translucent material configured with an aperture for receiving a plug. By way of example and not limitation this plug may take the form of an RJ type connector. The substantially translucent material is preferably made of a unitary article such as a thermoplastic or a glass. By "unitary article," it is understood that the article is formed, molded, or machined from substantially a single piece of material. However, non-unitary articles also function effectively. The presently preferred material for the translucent portions is ULTEM®, a polyetherimide made by GE plastics of Pittsfield, Mass. Other suitable materials include LEXAN 940A®, LEXAN 920®, and LEXAN 920A®, polysulphone, polyester, polyvinyl chloride (PVC), styrene acrylonitrile (SAN) and glass.

The connector may also include one or more means for redirecting light energy within the connector body. One example of a means for redirecting light energy within the connector body, given by way of example and not by limitation, is a portion of the exterior surface of the connector that is set at a non-perpendicular angle to the incidence of the focused beam of light such that a substantial portion of the light beam is reflected therefrom. Another example, among others, of a means for redirecting a focused beam of light within the connector body is a polished portion of the exterior surface that is set at a non-perpendicular angle to the incidence of the launched light. These surfaces may be treated and shaped to yield any number of combinations of light reflection, refraction, separation and filtration to form separate light beams, beams of different color and beams of varying intensity and luminescence.

Another means for redirecting a focused beam of light may be any number of reflective surfaces, for example and not as a limitation, planar mirrors or shaped mirrors such as a parabolic or other concave mirror. Another means for directing or redirecting light within the connector body, given by way of example and not as a limitation, is a layer of reflective material or material with a refractive index different from that of the connector body which serves to channel a given light beam to a specific destination and separate the light beam from other distinct beams.

Figure 2D:
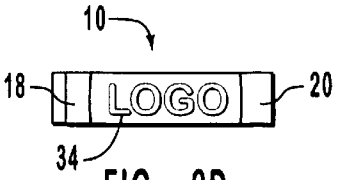
FIG. 2D is a front end view of the inventive XJACK depicted in FIG. 2A.
Figure 2B:
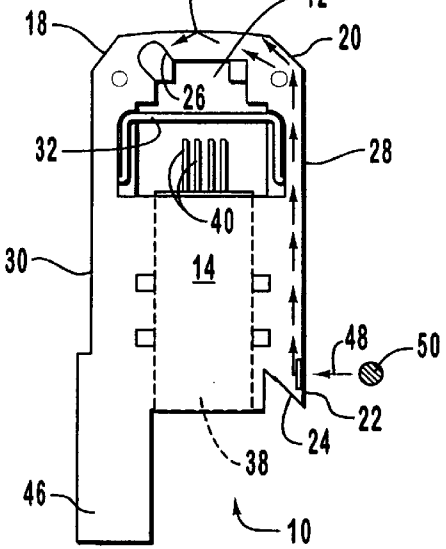
FIG. 2B is a bottom plan view of the inventive XJACK depicted in FIG. 2A.
Figure 2C:
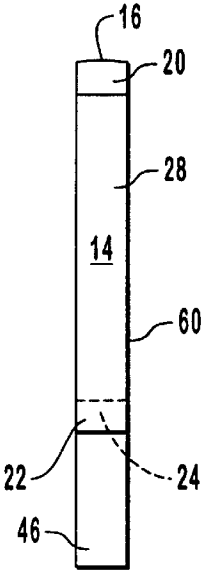
FIG. 2C is a first side view of the inventive XJACK depicted in FIG. 2A.
Figure 2A:
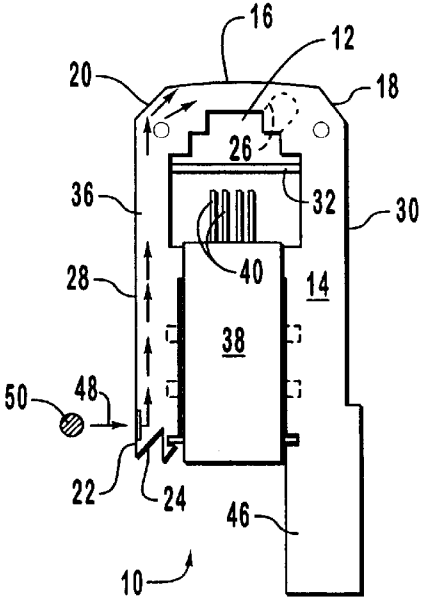
FIG. 2A is a top plan view of an inventive extendable and retractable XJACK.
Figure 2E:
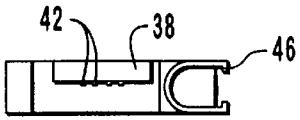
FIG. 2E is a back end view of the inventive XJACK depicted in FIG. 2A.
Figure 2F:
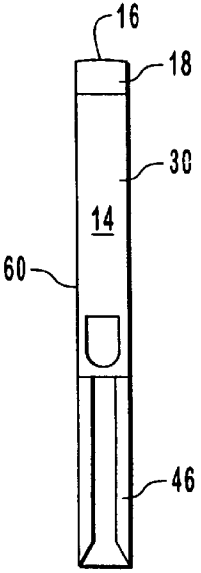
FIG. 2F is a second side view of the inventive XJACK depicted in FIG. 2A.
Figure 3:
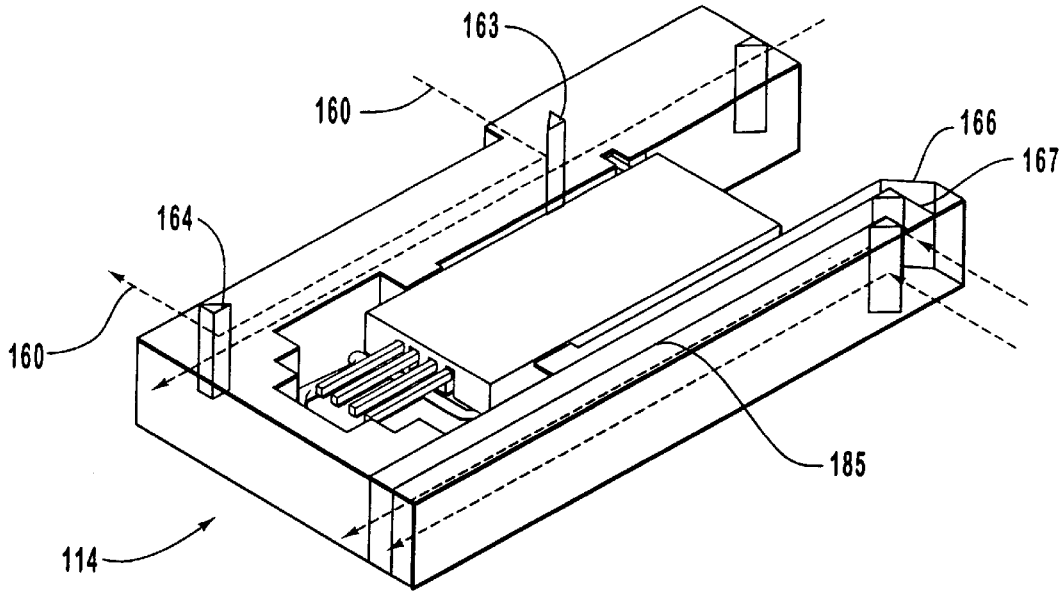
FIG. 3 is a perspective view of a translucent retractable XJACK which receives several distinct beams of light which are redirected to specific locations to indicate diagnostic information.

FIGS. 2A through 2F illustrate a first embodiment of the present invention. FIG. 2D is a top plan view of a connector 10 that is an XJACK® manufactured by 3Com Corporation of Salt Lake City, Utah for a laptop, notebook, subnotebook computer, PDA and the like. An aperture 12 is provided in connector 10 to receive a plug (not pictured). Connector 10 includes a translucent body 14 and a contact pin insert 38. Translucent body 14 includes a terminal surface 16 that may be flat, arcuate or molded to display various indicia. Along the sides of connector 10 is a first side surface 28 and a second side surface 30. A top surface 60 joins first side surface 28 and second side surface 30. A stirrup 32 may be provided within aperture 12. Connector 10 is illuminated by focusing a beam of concentrated light 48 radiating from a concentrated light source 50, onto a means for receiving a focused beam of light 22 along first side surface 28.

A focused light beam 48 enters connector 10 through a means for receiving a focused beam of light 22 which comprises a substantially transparent portion of body 14, a specially prepared lens formed in or attached to body 14, a physical opening in body 14 or other means for allowing a focused beam of light to enter body 14. It is understood, however, that the means for receiving a focused beam of light 22 may be simply a portion of the translucent first side surface 28 of connector 10.

Once focused beam of light 48 enters body 14 through means for receiving 22 the beam 48 may be redirected to a specific section of body 14 by a means for redirecting light 24 comprising a lens, a mirror or other reflective surface, a refractive element, a filter, waveguide structure, a combination of these elements or another element which may redirect light. The focused beam of light may also be filtered to achieve a desired color or other effect or dispersed to achieve greater luminescence in a given area.

The efficiency of the means for receiving a focused beam of light 22 will vary with the angle of incidence of the incoming beam, the configuration of the element used and the material used. The optimum angle between the means for receiving 22 and the incoming beam of light 48 will vary depending on the location of the light source 50, the configuration of the connector body 14 and the type of receiving means used. However, in the preferred embodiment, a substantially perpendicular angle between the incoming beam of light 48 and the surface of the receiving means 22 has yielded preferential results with a substantially planar receiving means 22. The structural and geometric configuration of the means for redirecting 24 will also vary depending on the location of the incoming focused beam of light 48 and the desired effect to be achieved by the means for redirecting 24, be it a refractive effect, a reflective effect, dispersion or otherwise.

Once focused beam of light 48 has entered body 14 through receiving means 22 it may be redirected, filtered or dispersed any number of times to achieve a desired effect or target a specified area. As an example, focused beam of light 48 enters body 14 through receiver 22 and is redirected by redirector 24 toward left bevel 20 which is also a redirector guiding light beam 48 to front face 16 from which light may radiate thereby illuminating indicia 34 to identify the device model or manufacturer. Interior redirector 26 also guides light toward front face 16 increasing illumination.

A focused beam of light 160 may also be directed into translucent connector body 14 from the side and redirected by redirecting means 163 in a longitudinal direction toward redirecting means 164 which then redirects beam 160 out the side of connector body 14 where it may be visually detected and serve as an indicator of the state of the electronic connection or some other attribute or condition. At the same time and in the same connector additional focused light beams may enter body 14 from other locations and be, likewise, redirected by redirecting means 166 & 167 to selectively illuminate distinct areas or disperse to illuminate broad portions of a connector.

Figure 4:
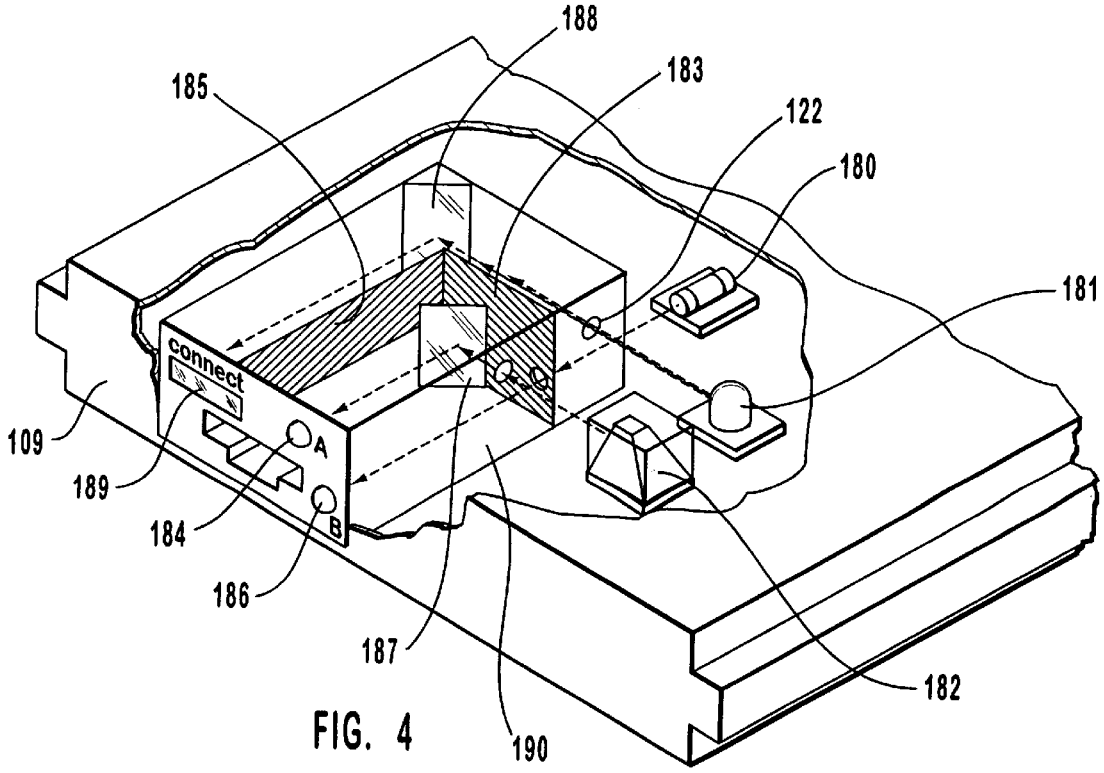
FIG. 4 is a perspective view of a translucent fixed connector which receives a plurality of light beams for functional illumination.

A means for focusing a beam of light 50, 180, 181 & 182 may be located virtually anywhere within the electronic device. The beam may enter the body 14 from any surface so long as a means for receiving 22 may be configured therein. FIG. 4 shows multiple light sources 180, 181 & 182 which may take to form of LED's specially configured with fresnel lenses and/or parabolic reflectors or other means for focusing light on a specific area. The source of the focused light beam 50, 180, 181 & 182 may also be a laser. It is to be understood that the means for focusing a beam of light comprises methods of optically focusing light as well as methods of electrically amplifying, concentrating and directing visible radiation and combinations of these methods.

In one fixed connector embodiment shown in FIG. 4, light source 182 provides light which is focused on a substantially transparent portion of side surface 190. The beam of light from source 182, once passing through surface 190 is redirected by reflective surface 187 to colored lens or bezel 184 which illuminates to indicate a diagnostic condition of the electronic device 109. Light source 181 is also directed into side surface 190, but through receiving lens 122 which focuses the beam on redirector 188 which reflects a mildly dispersed beam onto colored bezel 189 thereby providing functional illumination. Optic dividers 183 & 185 may be used as necessary to prevent light from separate beams designated as distinct indicators, from diffusing into areas intended to be illuminated by other beams. Optic dividers 183 & 185 may be opaque reflective film, solid opaque sheets, or merely material with a different refractive index which serve to direct light along a path to its destination and prevent light from diffusing into areas intended to be illuminated by other light sources. Optic dividers may not be necessary for highly transparent connectors, but connectors made from materials with high diffusion rates which use multiple light beams in close proximity may require their use.

Once a beam of light has entered body 14 and has been redirected to its desired final destination on the exterior of body 14 the light will exit body 14 as visible light. The various exterior surfaces of body 14 from which light exits may be molded, shaped, formed, tinted, pigmented, painted, textured, or otherwise treated to alter and enhance the perception of the light radiating therefrom. For example, the manufacturers name or model of the device to which the connector is attached may be molded 34 into the front surface 16 and light may be directed out of that surface thereby illuminating the message thereon. Additionally, by way of example, attachments such as colored lenses or filters 184 may be formed into a surface or attached thereto to enhance the appearance of or improve the visibility of light directed thereto.

Figure 5:
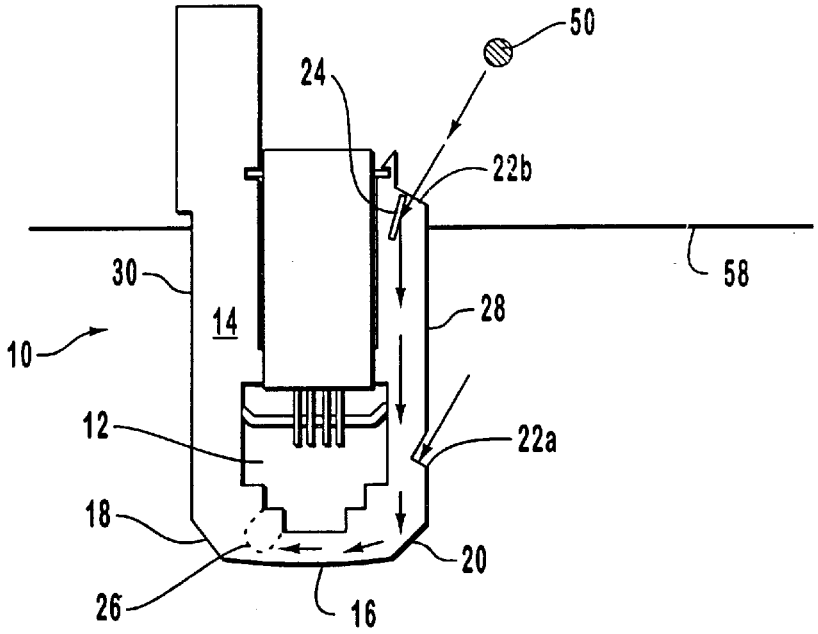
FIG. 5 is a plan view of an XJACK that is slidably disposed at the edge of an electronic device and that is illuminated by an LED that is configured to focus a concentrated beam of light against reflective surfaces of the inventive XJACK.

In one retractable connector embodiment of the present invention, multiple light receiving means 22A & 22B may be positioned on body 14 so as to transmit light through body 14 in both the retracted and extended positions as shown in FIG. 5. The light source or means for focusing a beam of light 50 is positioned within the device at a location where it will focus a beam of light 48 onto body 14 in both the retracted and extended positions. Multiple means for receiving the focused beam of light 22A & 22B are positioned on body 14 at locations which will receive the incident focused beam of light 48 when the connector 10 is in the retracted and extended positions. In this embodiment, when the connector 10 is retracted, focused beam of light 48 shines into receiving means 22A and illuminates the front face 16 and any indicia 34 that may be located on front face 16. When the connector is extended, focused beam of light 48 shines on receiving means 22B thereby illuminating a greater portion of body 14 by causing light to radiate from the sides, top and bottom of the portion of body 14 which becomes visible when the connector 10 is in the extended position. This scheme may also be employed in combination with circuitry that changes the color or intermittent light pattern of the focused beam of light 48.

Figure 6:
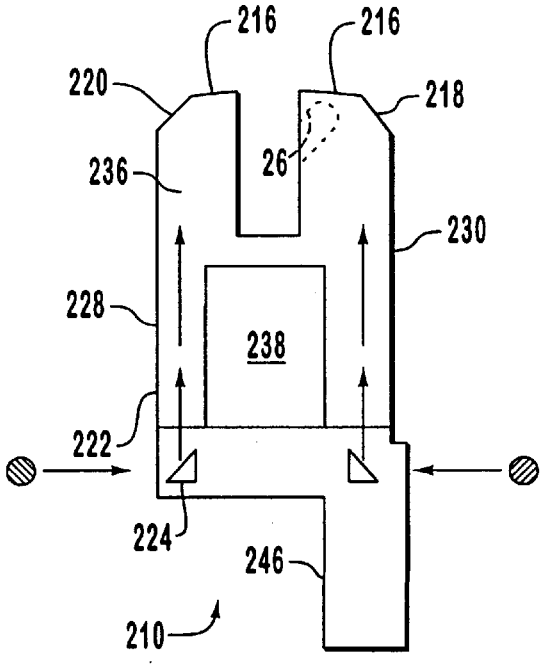
FIG. 6 is a plan view of a type of alligator jack shown with light redirectors and light sources.

In another embodiment of the retractable connector, shown in FIG. 6 and known as a type of alligator jack, the connector 210 has a forked configuration which allows each fork to be conveniently illuminated, either by separate light sources or by a single light source with a focused beam that is optically split and redirected into both forks of the connector.

Figure 7:
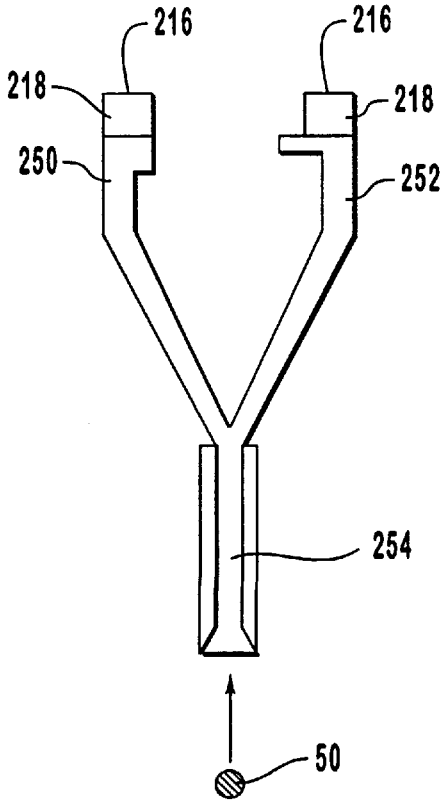
FIG. 7 is a plan view of a type of alligator jack shown with a light source.

FIG. 7 also depicts an alternative alligator type forked connector which may be illuminated, when composed of translucent material, by directing light into the connector stem 254 which will be naturally transmitted up stem 254 and into both forks 250 & 252 of the connector.

It may be appreciated that the particular connector that is required for a given application may be an XJACK®, an embedded connector such as for the reception of a telephone or LAN cable, an alligator connector, an RJ type connector, or other electronic connectors.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

We claim:

1. A functionally illuminated connector for an electronic device, said connector comprising:

one or more translucent portions;

means for receiving one or more focused beams of light into said one or more translucent portions; and said electronic device comprising means for focusing one or more beams of light onto said means for receiving, and wherein said connector is retractably mounted to said device so that said connector rests in a first position wherein said connector is substantially contained within said device and said connector also rests in a second position wherein said connector protrudes from said device allowing a plug to be inserted substantially perpendicular to a direction of retracting into an aperture of said connector.

2. The connector of claim 1 wherein said means for receiving and said means for focusing each operationally communicate so as to functionally illuminate said connector in said first position and in said second position.

3. The connector of claim 1 wherein said means for receiving comprises one or more refractive or reflective surfaces which direct light throughout said one or more translucent portions.

4. The connector of claim 1 wherein said means for receiving comprises one or more refractive or reflective surfaces which direct light to one or more specific areas of said one or more translucent portions.

5. The connector of claim 4 wherein the illumination of said one or more specific areas indicates the state or condition of the electrical device or the state or condition of the connection thereto.

6. The connector of claim 4 wherein said one or more specific areas are configured to illuminate with different colors.

7. The connector of claim 6 wherein said different colors are effected through the use of multiple LED's of varying colors.

8. The connector of claim 6 wherein said different colors are effected through the use of varying pigmentation of said one or more translucent portions.

9. The connector of claim 6 wherein said different colors are effected through the use of multi-colored LED's of varying colors.

10. The connector of claim 1 wherein said means for receiving is an exterior surface of said one or more translucent portions which is substantially transparent.

11. The connector of claim 1 wherein said means for receiving is a lens comprised in said one or more translucent portions.

12. The connector of claim 1 wherein said means for focusing is a fresnel lens.

13. The connector of claim 1 wherein said means for focusing is a laser.

14. A functionally illuminated connector for an electronic device, said connector comprising:

a connector body having a thickness smaller than a cross-section of a connector plug capable of mating with the connectors the connector body also having formed therein an aperture for receiving said plug;

said body comprising one or more translucent portions;

means for receiving one or more focused beams of light into said one or more translucent portions;

means for focusing one or more beams of light onto said means for receiving, and wherein said connector is retractable mounted to said device so that said connector rests in a first position wherein said connector is substantially contained within said device and said connector also rests in a second position wherein said connector protrudes from said device allowing said plug to be inserted substantially perpendicular to direction of retraction into said aperture of said connector body.

15. The functionally illuminated connector of claim 14 wherein said connector body is retractable within said electronic device so that said connector body occupies a first position wherein the connector is substantially contained within said device and said connector body occupies a second position wherein said connector body protrudes from said electronic device allowing a media plug to be received by said connector.

16. The connector of claim 14 wherein said means for focusing is a fresnel lens.

17. The connector of claim 14 wherein said means for focusing is a laser.

18. A functionally illuminated connector for an electronic device, said connector comprising:

one or more translucent portions;

means for receiving one or more focused beams of light into said one or more translucent portions;

means for focusing one or more beams of light onto said means for receiving, and wherein said connector is retractably mounted to said device so that said connector rests in a first position wherein said connector is substantially contained within said device and said connector also rests in a second position wherein said connector protrudes from said device allowing a plug to be inserted substantially perpendicular to a direction of retraction into an aperture of said connector.

19. The connector of claim 18 wherein said means for focusing is a fresnel lens.

20. The connector of claim 18 wherein said means for focusing is a laser.

* * * * *

UNITED STATES PATENT AND TRADEMARK OFFICE

CERTIFICATE OF CORRECTION

PATENT NO. : 6,257,906 B1
DATED : July 10, 2001
INVENTOR(S) : Price et al.

It is certified that error appears in the above-identified patent and that said Letters Patent is hereby corrected as shown below:

Title page,
Item [75], Inventors, add -- Brent D. Madsen, Providence -- to the list of inventors Column 5,
Line 67, before "and III" change "I," to -- II, --

Column 10,
Line 41, after "direction of" change "retracting" to -- retraction --

Column 11,
Line 18, before "the connector body" change "connectors" to -- connector, --
Line 26, before "mounted" change "retractable" to -- retractably --
Line 31, after "perpendicular to" insert -- a --

Signed and Sealed this

Eleventh Day of June, 2002

*Attest:*

*Attesting Officer*

JAMES E. ROGAN
*Director of the United States Patent and Trademark Office*